US009187960B2

(12) United States Patent
Radford et al.

(10) Patent No.: US 9,187,960 B2
(45) Date of Patent: Nov. 17, 2015

(54) EXPANDABLE REAMER TOOLS

(71) Applicant: Baker Hughes Incorporated, Houston, TX (US)

(72) Inventors: Steven R. Radford, The Woodlands, TX (US); Scott Shiqiang Shu, Spring, TX (US); Les T. Shale, Willis, TX (US); Mark E. Morris, Coraopolis, PA (US); Mark R. Kizziar, Lafayette, LA (US); Anton F. Zahradnik, Sugar Land, TX (US)

(73) Assignee: BAKER HUGHES INCORPORATED, Houston, TX (US)

( * ) Notice: Subject to any disclaimer, the term of this patent is extended or adjusted under 35 U.S.C. 154(b) by 0 days.

(21) Appl. No.: 13/909,558

(22) Filed: Jun. 4, 2013

(65) Prior Publication Data

US 2013/0264122 A1 Oct. 10, 2013

Related U.S. Application Data

(62) Division of application No. 13/182,083, filed on Jul. 13, 2011, now Pat. No. 8,453,763, which is a division of application No. 11/949,627, filed on Dec. 3, 2007, now Pat. No. 7,997,354.

(60) Provisional application No. 60/872,745, filed on Dec. 4, 2006.

(51) Int. Cl.
*E21B 10/32* (2006.01)

(52) U.S. Cl.
CPC ..... *E21B 10/322* (2013.01)

(58) Field of Classification Search
CPC ..... E21B 10/322; E21B 10/32
USPC ..... 175/57, 267, 269, 385
See application file for complete search history.

(56) References Cited

U.S. PATENT DOCUMENTS

| | | | |
|---|---|---|---|
| 1,678,075 | A | 7/1928 | Phipps |
| 2,069,482 | A | 2/1937 | Seay |
| 2,177,721 | A | 10/1939 | Johnson et al. |

(Continued)

FOREIGN PATENT DOCUMENTS

| | | | |
|---|---|---|---|
| EP | 0246789 | A2 | 11/1987 |
| EP | 0301890 | B1 | 6/1992 |

(Continued)

OTHER PUBLICATIONS

International Preliminary Report on Patentability for International Application No. PCT/US2007/024766, dated Jun. 10, 2009.

(Continued)

*Primary Examiner* — Catherine Loikith
(74) *Attorney, Agent, or Firm* — TraskBritt

(57) ABSTRACT

Expandable reamer tools include an outer body, a fluid passageway extending through the outer body, and at least one blade configured to slide relative to the outer body between a retracted position and an expanded position. In some embodiments, the tools may include a formation-engaging surface comprising a gage area. In other embodiments, the tools may include a radially recessed area extending from a back edge of the formation-engaging surface. Methods for removing such expandable reamer tools from a borehole are also disclosed.

22 Claims, 9 Drawing Sheets

(56) References Cited

U.S. PATENT DOCUMENTS

| | | | |
|---|---|---|---|
| 2,344,598 | A | 3/1944 | Church |
| 2,754,089 | A | 7/1956 | Kammerer, Jr. |
| 2,758,819 | A | 8/1956 | Kammerer, Jr. |
| 2,834,578 | A | 5/1958 | Carr |
| 2,882,019 | A | 4/1959 | Carr et al. |
| 3,105,562 | A | 10/1963 | Stone et al. |
| 3,123,162 | A | 3/1964 | Rowley |
| 3,126,065 | A | 3/1964 | Chadderdon |
| 3,211,232 | A | 10/1965 | Grimmer |
| 3,224,507 | A | 12/1965 | Cordary et al. |
| 3,425,500 | A | 2/1969 | Fuchs |
| 3,433,313 | A | 3/1969 | Brown |
| 3,556,233 | A | 1/1971 | Gilreath |
| 4,055,226 | A | 10/1977 | Weber |
| 4,403,659 | A | 9/1983 | Upchurch |
| 4,458,761 | A | 7/1984 | Van Vreeswyk |
| 4,545,441 | A | 10/1985 | Williamson |
| 4,589,504 | A | 5/1986 | Simpson |
| 4,635,738 | A | 1/1987 | Schillinger et al. |
| 4,660,657 | A | 4/1987 | Furse et al. |
| 4,690,229 | A | 9/1987 | Raney |
| 4,693,328 | A | 9/1987 | Furse et al. |
| 4,842,083 | A | 6/1989 | Raney |
| 4,848,490 | A | 7/1989 | Anderson |
| 4,854,403 | A | 8/1989 | Ostertag et al. |
| 4,884,477 | A | 12/1989 | Smith et al. |
| 4,889,197 | A | 12/1989 | Boe |
| 5,139,098 | A | 8/1992 | Blake |
| 5,211,241 | A | 5/1993 | Mashaw, Jr. et al. |
| 5,224,558 | A | 7/1993 | Lee |
| 5,265,684 | A | 11/1993 | Rosenhauch |
| 5,293,945 | A | 3/1994 | Rosenhauch et al. |
| 5,305,833 | A | 4/1994 | Collins |
| 5,318,131 | A | 6/1994 | Baker |
| 5,318,137 | A | 6/1994 | Johnson et al. |
| 5,318,138 | A | 6/1994 | Dewey et al. |
| 5,332,048 | A | 7/1994 | Underwood et al. |
| 5,343,963 | A | 9/1994 | Bouldin et al. |
| 5,361,859 | A | 11/1994 | Tibbitts |
| 5,368,114 | A | 11/1994 | Tandberg et al. |
| 5,375,662 | A | 12/1994 | Echols, III et al. |
| 5,402,856 | A | 4/1995 | Warren et al. |
| 5,415,243 | A | 5/1995 | Lyon et al. |
| 5,425,423 | A | 6/1995 | Dobson et al. |
| 5,437,308 | A | 8/1995 | Morin et al. |
| 5,495,899 | A | 3/1996 | Pastusek et al. |
| 5,497,842 | A | 3/1996 | Pastusek et al. |
| 5,553,678 | A | 9/1996 | Barr et al. |
| 5,560,440 | A | 10/1996 | Tibbitts |
| 5,740,864 | A | 4/1998 | de Hoedt et al. |
| 5,765,653 | A | 6/1998 | Doster et al. |
| 5,788,000 | A | 8/1998 | Maury et al. |
| 5,823,254 | A | 10/1998 | Dobson et al. |
| 5,853,054 | A | 12/1998 | McGarian et al. |
| 5,887,655 | A | 3/1999 | Haugen et al. |
| 5,957,223 | A | 9/1999 | Doster et al. |
| 6,039,131 | A | 3/2000 | Beaton |
| 6,059,051 | A | 5/2000 | Jewkes et al. |
| 6,109,354 | A | 8/2000 | Ringgenberg et al. |
| 6,116,336 | A | 9/2000 | Adkins et al. |
| 6,131,675 | A | 10/2000 | Anderson |
| 6,189,631 | B1 | 2/2001 | Sheshtawy |
| 6,213,226 | B1 | 4/2001 | Eppink et al. |
| 6,227,312 | B1 | 5/2001 | Eppink et al. |
| 6,269,893 | B1 | 8/2001 | Beaton et al. |
| 6,289,999 | B1 | 9/2001 | Dewey et al. |
| 6,325,151 | B1 | 12/2001 | Vincent et al. |
| 6,360,831 | B1 | 3/2002 | Akesson et al. |
| 6,378,632 | B1 | 4/2002 | Dewey et al. |
| 6,488,104 | B1 | 12/2002 | Eppink et al. |
| 6,494,272 | B1 | 12/2002 | Eppink et al. |
| 6,499,537 | B1 | 12/2002 | Dewey et al. |
| 6,615,933 | B1 | 9/2003 | Eddison |
| 6,668,936 | B2 | 12/2003 | Williamson, Jr. et al. |
| 6,668,949 | B1 | 12/2003 | Rives |
| 6,708,785 | B1 | 3/2004 | Russell et al. |
| 6,732,817 | B2 | 5/2004 | Dewey et al. |
| 6,929,076 | B2 | 8/2005 | Fanuel et al. |
| 6,971,459 | B2 | 12/2005 | Raney |
| 7,036,611 | B2 | 5/2006 | Radford et al. |
| 7,048,078 | B2 | 5/2006 | Dewey et al. |
| 7,293,616 | B2 | 11/2007 | Tulloch |
| 7,314,099 | B2 | 1/2008 | Dewey et al. |
| 7,513,318 | B2 | 4/2009 | Underwood et al. |
| 7,658,241 | B2 | 2/2010 | Lassoie et al. |
| 7,900,717 | B2 | 3/2011 | Radford et al. |
| 2002/0070052 | A1 | 6/2002 | Armell et al. |
| 2003/0029644 | A1 | 2/2003 | Hoffmaster et al. |
| 2003/0079913 | A1 | 5/2003 | Eppink et al. |
| 2004/0065479 | A1 | 4/2004 | Fanuel et al. |
| 2004/0134687 | A1 | 7/2004 | Radford et al. |
| 2005/0145417 | A1* | 7/2005 | Radford et al. ..... 175/57 |
| 2005/0241856 | A1 | 11/2005 | Lassoie et al. |
| 2008/0128174 | A1 | 6/2008 | Radford et al. |
| 2011/0266060 | A1 | 11/2011 | Radford et al. |
| 2011/0284233 | A1 | 11/2011 | Wu et al. |

FOREIGN PATENT DOCUMENTS

| | | | |
|---|---|---|---|
| EP | 0594420 | B1 | 12/1997 |
| EP | 1036913 | A1 | 9/2000 |
| EP | 1044314 | A1 | 10/2000 |
| GB | 2328964 | A | 3/1999 |
| GB | 2344122 | A | 5/2000 |
| GB | 2344607 | A | 6/2000 |
| GB | 2344122 | B | 4/2003 |
| GB | 2385344 | A | 8/2003 |
| GB | 2393748 | A | 4/2004 |
| WO | 0031371 | | 6/2000 |
| WO | 2004097163 | A1 | 11/2004 |

OTHER PUBLICATIONS

International Search Report for International Application No. PCT/US2007/024766, mailed Mar. 12, 2008.

International Written Opinion for International Application No. PCT/US2007/024766, mailed Mar. 12, 2008.

Radford, Steven, et al., "Novel Concentric Expandable Stabilizer Results in Increased Penetration Rates and Drilling Efficiency with Reduced Vibration," SPE/IADC 119534, prepared for presentation at the SPE/IADC Drilling Conference and Exhibition held in Amsterdam, The Netherlands, Mar. 17-19, 2009, 13 pages.

Translation of Russian Office Action for Russian Application No. 2009125440 dated Jul. 20, 2011, 3 pages.

* cited by examiner

EXPANDABLE REAMER TOOLS

CROSS-REFERENCE TO RELATED APPLICATIONS

This application is a divisional of U.S. patent application Ser. No. 13/182,083, filed Jul. 13, 2011, now U.S. Pat. 8,453,763, issued Jun. 4, 2013, which is a divisional of U.S. patent application Ser. No. 11/949,627, filed Dec. 3, 2007, now U.S. Pat. 7,997,354, issued Aug. 16, 2011, which claims the benefit of U.S. Provisional Patent Application Ser. No. 60/872,745, filed Dec. 4, 2006, the disclosure of each of which applications is hereby incorporated herein in its entirety by this reference.

TECHNICAL FIELD

The present invention relates generally to drilling of subterranean well bores. More particularly, the present invention relates to expandable reamer tools and methods of using such tools to enlarge a subterranean well bore. The expandable reamer tools may comprise a tubular body configured with expandable blades that may be positioned in a first retracted position and then displaced radially outward and upward to a second expanded position.

BACKGROUND

In drilling oil, gas, and geothermal wells, casing is conventionally installed and cemented to prevent the well walls from caving into the subterranean borehole. Casing is also conventionally installed to isolate different formations, to prevent crossflow of formation fluids, and to enable control of formation fluids and pressure as the borehole is drilled. To increase the depth of a previously drilled borehole, new casing is laid within the previous casing. While adding additional casing allows a borehole to reach greater depths, it has the disadvantage of narrowing the borehole. Narrowing the borehole restricts the diameter of any subsequent sections of the well because the drill bit and any further casing must pass through the existing casing. As reductions in the borehole diameter are undesirable because they limit the production flow rate of oil and gas through the borehole, it is often desirable to enlarge a subterranean borehole to provide a larger borehole diameter for installing additional casing beyond previously installed casing or to enable better production flow rates of hydrocarbons through the borehole.

A variety of approaches have been employed for enlarging a borehole diameter. One conventional approach used to enlarge a subterranean borehole includes using eccentric and bi-center bits. For example, an eccentric bit with an extended or enlarged cutting portion is rotated about its axis thereby producing an enlarged borehole diameter. An example of an eccentric bit is disclosed in U.S. Pat. No. 4,635,738, assigned to the assignee of the present invention. A bi-center bit assembly employs two longitudinally superimposed bit sections with laterally offset axes, which when rotated produce an enlarged borehole diameter. An example of a bi-center bit is disclosed in U.S. Pat. No. 5,957,223, which is also assigned to the assignee of the present invention.

Another conventional approach used to enlarge a subterranean borehole includes employing an extended bottom-hole assembly with a pilot drill bit at the distal end thereof and a reamer assembly some distance above. This arrangement permits the use of any standard rotary drill bit type, be it a rock bit or a drag bit, as the pilot bit, and the extended nature of the assembly permits greater flexibility when passing through tight spots in the borehole as well as the opportunity to effectively stabilize the pilot drill bit so that the pilot hole and the following reamer will traverse the path intended for the borehole. This aspect of an extended bottom-hole assembly is particularly significant in directional drilling. The assignee of the present invention has, to this end, designed as reaming structures so-called "reamer wings," which generally comprise a tubular body having a fishing neck with a threaded connection at the top thereof and a tong die surface at the bottom thereof, also with a threaded connection. U.S. Pat. Nos. 5,497,842 and 5,495,899, both assigned to the assignee of the present invention, disclose reaming structures including reamer wings. The upper midportion of the reamer wing tool includes one or more longitudinally extending blades projecting generally radially outwardly from the tubular body, the outer edges of the blades carrying PDC cutting elements.

Conventional expandable reamers may include blades pivotably or hingedly affixed to a tubular body and actuated by way of a piston disposed therein as disclosed by U.S. Pat. No. 5,402,856 to Warren. In addition, U.S. Pat. No. 6,360,831 to Akesson et al., discloses a conventional borehole opener comprising a body equipped with at least two hole-opening aims having cutting means that may be moved from a position of rest in the body to an active position by exposure to pressure of the drilling fluid flowing through the body. The blades in these reamers are initially retracted to permit the tool to be run through the borehole on a drill string and once the tool has passed beyond the end of the casing, the blades are extended so the bore diameter may be increased below the casing.

The blades of conventional expandable reamers have been sized to minimize a clearance between themselves and the tubular body in order to prevent any drilling mud and earth fragments from becoming lodged in the clearance and binding the blade against the tubular body.

Notwithstanding the various prior approaches to drill and/or ream a larger-diameter borehole below a smaller-diameter borehole, the need exists for improved apparatus and methods for doing so. For instance, bi-center and reamer wing assemblies are limited in the sense that the pass-through diameter is nonadjustable and limited by the reaming diameter. Furthermore, conventional bi-center and eccentric bits may have the tendency to wobble and deviate from the path intended for the borehole. Conventional expandable reaming assemblies, while more stable than bi-center and eccentric bits, may be subject to damage when passing through a smaller diameter borehole or casing section, may be prematurely actuated, and may present difficulties in removal from the borehole after actuation.

BRIEF SUMMARY

In some embodiments, the present invention includes expandable reamer tools comprising an outer body, a fluid passageway extending through the outer body, and at least one blade configured to move relative to the outer body between a retracted position and an expanded position in a direction oriented at an acute angle of less than ninety degrees (90°) to a longitudinal axis of the outer body. Optionally, the tool may further comprise a moveable inner sleeve member configured to move from a first position to a second position in response to a predetermined hydraulic pressure differential created between portions of the fluid passageway. In the first position, the moveable inner sleeve member may prevent hydraulic pressure within the fluid passageway from acting on the at least one blade. In the second position, the moveable inner sleeve member may allow hydraulic pressure within the fluid passageway to act directly on the at least one blade.

In additional embodiments, the at least one blade may be sized and configured to provide a clearance between the outer body and each lateral surface of the at least one blade adjacent the outer body of greater than about ten-thousandths of an inch (0.010 in).

In some embodiments, the at least one blade may include a base portion having at least one angled surface configured to wedge against at least one complementary angled surface of the outer body when the blade is in the expanded position.

In yet additional embodiments, the at least one blade may include a formation-engaging surface including a longitudinally forward region including at least one forward cutting element and a longitudinally rearward region including at least one rear cutting element. The at least one forward cutting element may exhibit an exposure that is greater than any exposure exhibited by the at least one rear cutting element.

In yet additional embodiments, the at least one blade may have a formation-engaging surface including a gage area. The longitudinally rearward-most point of the gage area may be located a distance from a longitudinal centerline of the formation-engaging surface that is less than about twenty-five percent (25%) of a longitudinal length of the formation-engaging surface.

In additional embodiments, the at least one blade may have a formation-engaging surface including a gage area and a radially recessed area extending from a back edge of the formation-engaging surface in a longitudinally forward direction. The radially recessed area may extend a distance that is greater than about five percent (5%) of the longitudinal length of the formation-engaging surface.

In further embodiments, the expandable reamer may include a seal between the outer body (or a separate component secured to the outer body) and each lateral surface of the at least one blade adjacent the outer body. The seal may abut against the outer body at an angle perpendicular to each surface of the outer body in communication with the seal.

In further embodiments, the present invention includes methods of enlarging a borehole using such an expandable reamer tool. Drilling fluid is flowed through a fluid passageway extending through an outer body of an expandable reamer tool, which causes hydraulic pressure within the fluid passageway to act directly on a surface of at least one blade of the expandable reamer tool to cause the at least one blade to slide relative to the outer body in a direction oriented at an acute angle of less than ninety degrees (90°) to a longitudinal axis of the outer body from a retracted position to an expanded position. Then the expandable reamer tool is rotated within the borehole.

In yet additional embodiments, the present invention includes methods of removing an expandable reamer tool from a borehole. Such methods include pulling the expandable reamer from the borehole and causing an area of at least one blade of the expandable reamer located rearward a distance from a longitudinal centerline of a formation-engaging surface of the least one blade that is less than about forty-three percent (43%) of a longitudinal length of the formation-engaging surface to contact a structure forming a constricted portion of the borehole to cause the at least one blade to slide in a direction oriented at an acute angle of less than ninety degrees (90°) to a longitudinal axis of an outer body of the expandable reamer tool from an expanded position to a retracted position.

BRIEF DESCRIPTION OF THE DRAWINGS

While the specification concludes with claims particularly pointing out and distinctly claiming that which is regarded as the present invention, various features and advantages of this invention may be more readily ascertained from the following description of the invention when read in conjunction with the accompanying drawings, in which:

DETAILED DESCRIPTION

The illustrations presented herein are, in some instances, not actual views of any particular reamer tool, cutting element, or other feature of a reamer tool, but are merely idealized representations that are employed to describe the present invention. Additionally, elements common between figures may retain the same numerical designation.

Figure 1:
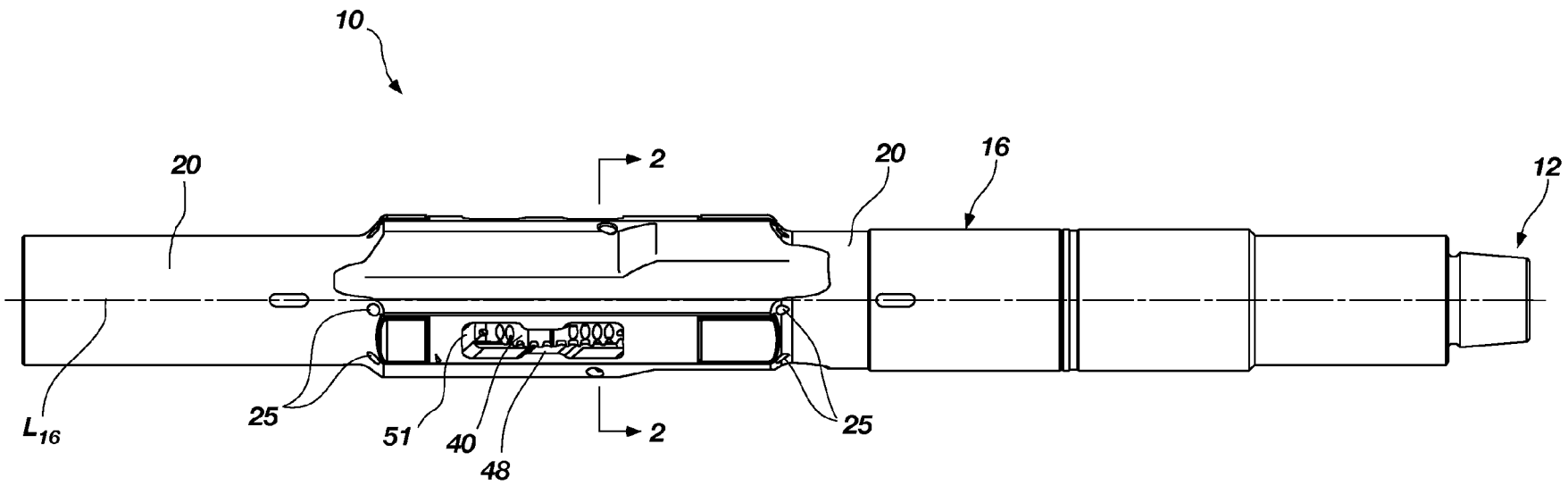
FIG. 1 is a side view of an embodiment of an expandable reamer of the present invention.

An expandable reamer tool 10, according to an embodiment of the present invention, is shown in FIG. 1. The expandable reamer tool 10 may include a generally cylindrical outer body 16 having a longitudinal axis $L_{16}$. The outer body 16 of the expandable reamer tool 10 may have a first lower end 12 and a second upper end 14. The terms "lower" and "upper," as used herein with reference to the ends 12, 14, refer to the typical positions of the ends 12, 14 relative to one another when the expandable reamer tool 10 is positioned within a well bore. The lower end 12 of the outer body 16 of the expandable reamer tool 10 may include a set of threads (e.g., a threaded male pin member) for connecting the lower end 12 to another section of a drill string or another component of a bottom-hole assembly (BHA), such as, for example, a pilot drill bit for drilling a well bore. Similarly, the upper end 14 of the outer body 16 of the expandable reamer tool 10 may include a set of threads (e.g., a threaded female box member)

for connecting the upper end 14 to another section of a drill string or another component of a bottom-hole assembly (BHA).

One or more blades 40 may be provided at a position along the expandable reamer tool 10 intermediate the first lower end 12 and the second upper end 14. The blades 40 may be comprised of steel, tungsten carbide, a particle-matrix composite material (e.g., hard particles dispersed throughout a metal matrix material), or other suitable materials as known in the art. The blades 40 may be moveable from a first radially inward or retracted position (shown in FIGS. 1, 3, and 5) to a second radially outward or expanded position (shown in FIG. 6). The expandable reamer tool 10 may be configured such that the blades 40 engage the walls of a subterranean earth formation within a well bore to remove formation material when the blades 40 are in the expanded position, but are not operable to so engage the walls of a subterranean earth formation within a well bore when the blades 40 are in the retracted position.

Figure 2:
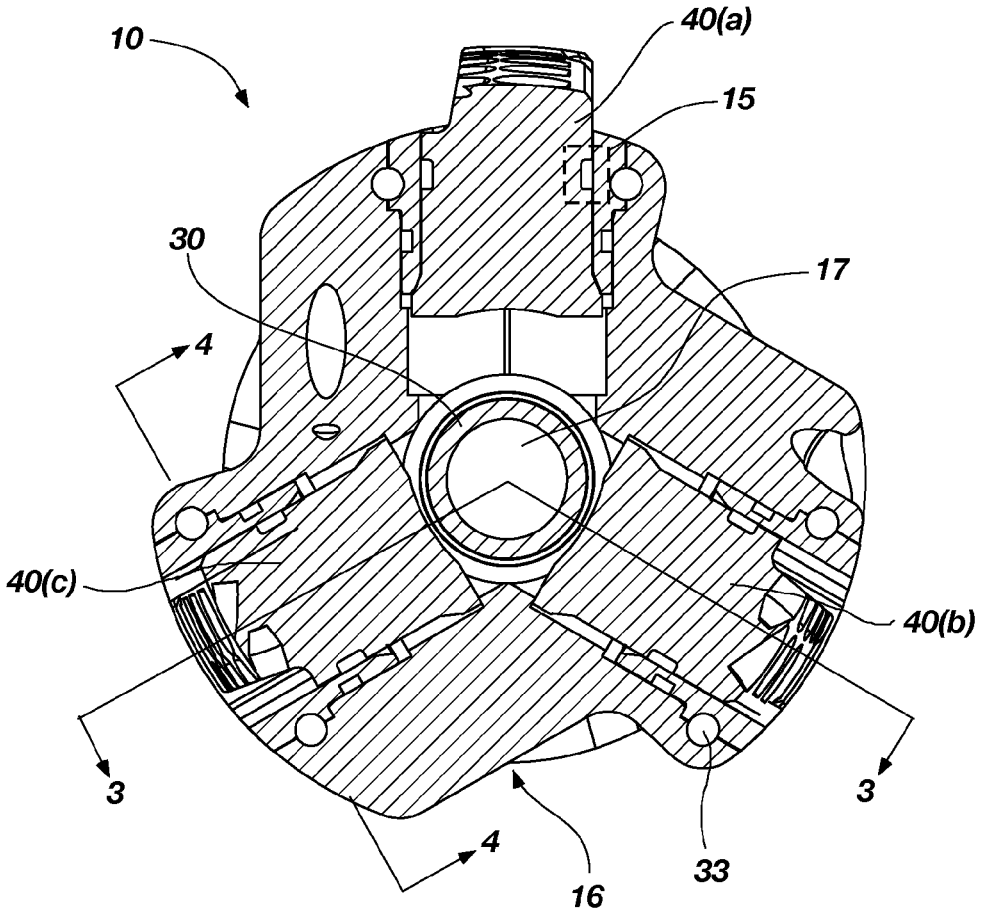
FIG. 2 is a cross-sectional view of the expandable reamer tool shown in FIG. 1 taken along section line 2-2 shown therein.

FIG. 2 is a cross-sectional view of the expandable reamer tool 10 shown in FIG. 1 taken along section line 2-2 shown therein. As shown in FIG. 2, the outer body 16 encloses a fluid passageway 17 that extends longitudinally through the outer body 16. By way of example and not limitation, the expandable reamer tool 10 may include three blades 40. Referring to FIG. 2, to better describe aspects of the present invention blades 40(*b*) and 40(*c*) are shown in the first radially inward or retracted position, while blade 40(*a*) is shown in the second radially outward or expanded position. The expandable reamer tool 10 may be configured such that the outermost radial or lateral extent of each of the blades 40 is recessed within the outer body 16 when in the first radially inward or retracted position so it does not extend beyond the outer diameter of the outer body 16. Such an arrangement may protect the blades 40 as the expandable reamer tool 10 is disposed within a smaller diameter casing of a borehole, and may allow the expandable reamer tool 10 to pass through such smaller casings within a borehole. In other embodiments, the outermost radial extent of the blades 40 may coincide with or slightly extend beyond the outer diameter of the outer body 16. As shown by blade 40(*a*), the blades 40 may extend beyond the outer diameter of the outer body 16 when in the second radially outward or expanded position, and thus may engage the walls of a borehole when disposed therein.

In some embodiments, the blades 40 may be substantially uniformly spaced circumferentially about the outer body 16 of the expandable reamer tool 10. In additional embodiments, the expandable reamer tool 10 may include one, two, four, or any other number of blades 40. Furthermore, in additional embodiments, the blades 40 may not be substantially uniformly spaced circumferentially about the outer body 16 of the expandable reamer tool 10.

Figure 3:
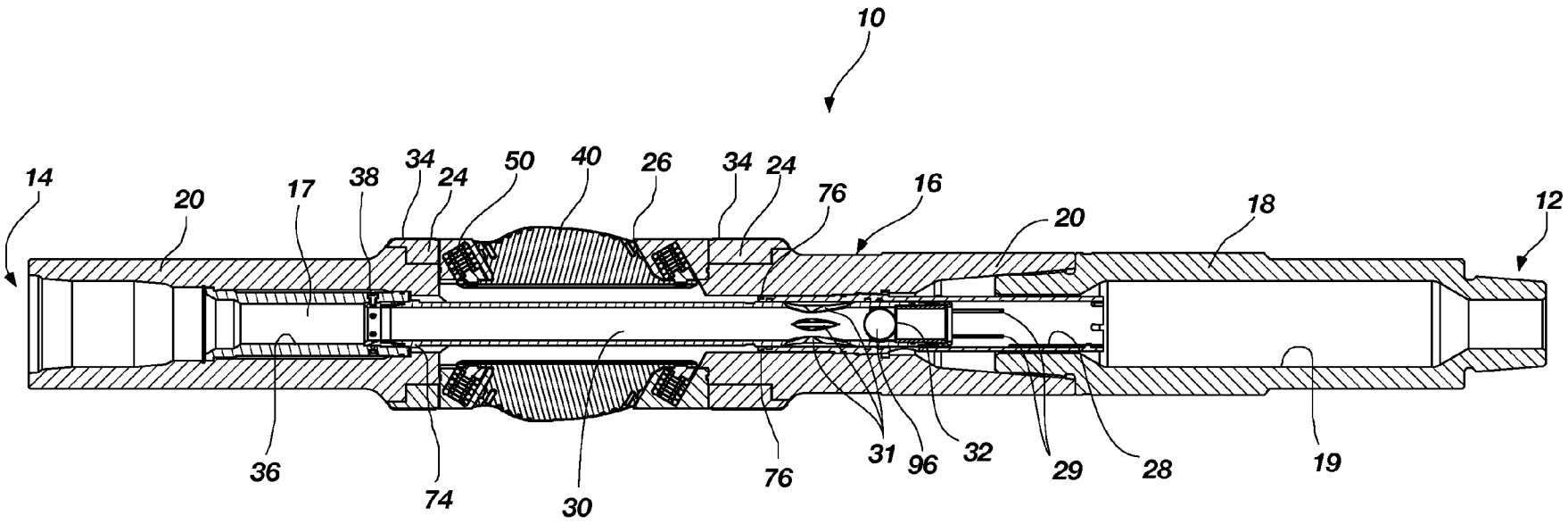
FIG. 3 is another cross-sectional view of the expandable reamer tool shown in FIGS. 1 and 2 taken along section line 3-3 shown in FIG. 2.

FIG. 3 is another cross-sectional view of the expandable reamer tool 10 shown in FIGS. 1 and 2 taken along section line 3-3 shown in FIG. 2. The outer body 16 of the expandable reamer tool 10 may include a plurality of components or sections that may be secured to one another to form the outer body 16. By way of example and not limitation, the outer body 16 may include a lower fluid bypass member 18, a blade plate 26, and one or more tool stabilization members 24.

In some embodiments, the expandable reamer tool 10 may include bearing pads 34 disposed proximate to one or both ends of the blades 40. In some embodiments, as shown in FIG. 3, the bearing pads 34 may be disposed both longitudinally forward and rearward of the blades 40 on the tool stabilization members 24. Thus, the bearing pads 34 may longitudinally precede or follow the blades 40 in the direction of drilling/reaming. Bearing pads 34 may comprise hardfacing material, diamond or other superabrasive materials, tungsten carbide, or other suitable abrasive and/or wear resistant materials. The bearing pads 34 may be sized to substantially correspond to the outer diameter of a pilot drill bit (not shown) affixed at or below the first lower end 12 (FIG. 1) of the expandable reamer tool 10. As a non-limiting example, a clearance of one-eighth (⅛) of an inch or less may be provided between the diameter defined by the outer surfaces of the bearing pads 34 and the diameter of the well bore (or the outer diameter of a pilot drill bit used to drill the well bore). Such a configuration may aid in stabilizing the expandable reamer tool 10 during use thereof.

The various components or sections of the outer body 16 may be secured to one another using, for example, cooperating threads, welded joints, and/or mechanically interlocking structures. In additional embodiments, the outer body 16 of the expandable reamer tool 10 may comprise fewer components. In other words, two or more of the lower fluid bypass member 18, sleeve retention member 20, blade plate 26, and tool stabilization members 24 may be integrally formed with one another to provide a unitary structure.

Figure 4:
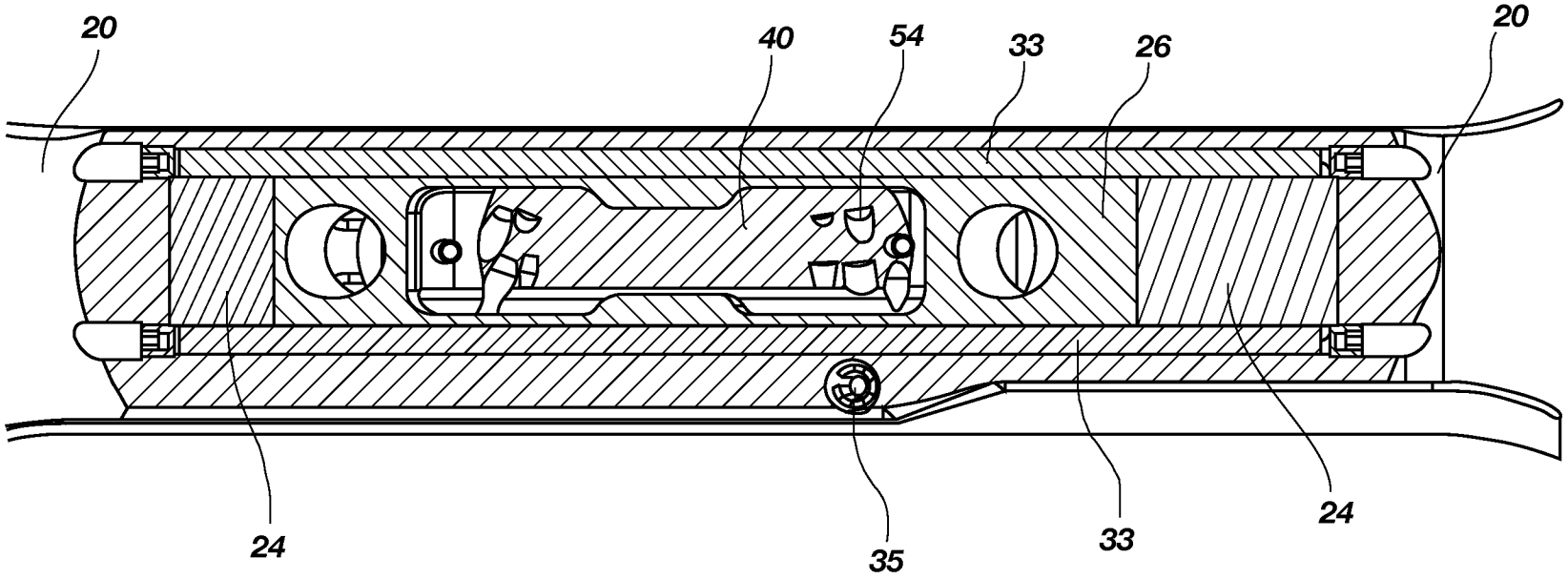
FIG. 4 is a cross-sectional view of the expandable reamer tool shown in FIGS. 1 through 3 taken along section line 4-4 shown in FIG. 2.

FIG. 4 is a cross-sectional view of the expandable reamer tool 10 shown in FIGS. 1 through 3, taken along the line 4-4 shown in FIG. 2. As shown in FIG. 4, in some embodiments, the blade plate 26 and the tool stabilization members 24 may be secured to the outer body 16 by removable lock rods 33. The removable lock rods 33 may extend into holes 25 (FIG. 1) formed within the sleeve retention member 20.

More specifically, the holes 25 formed in sleeve retention member 20 enable the removable lock rods 33 to be inserted therethrough, extending between the blade plate 26, the tool stabilization members 24, and the outer body 16, thus affixing the blade plate 26 and the tool stabilization members 24 to the outer body 16. When fully installed, removable lock rods 33 may extend substantially the longitudinal length of tool stabilization members 24 and the blade plate 26, but may extend further, depending on how the removable lock rods 33 are affixed to the outer body 16. Removable lock rods 33 may be threaded, pinned, welded, or otherwise affixed to the outer body 16. In some embodiments, the removable lock rods 33 may be detached from the outer body 16 to enable removal of the blade plate 26, blades 40, tool stabilization members 24, and bearing pads 34. Accordingly, the present invention contemplates that the blade plate 26, tool stabilization members 24, bearing pads 34, and/or blades 40 of the expandable reamer tool 10 may be removed, replaced, or repaired by way of removing the removable lock rods 33 from the holes 25 within the outer body 16 of the expandable reamer tool 10. Of course, many alternative removable retention configurations are possible including pinned elements, threaded elements, dovetail elements, or other connection elements known in the art to retain the blades 40.

As shown in FIG. 4, the expandable reamer tool 10 may also include at least one nozzle 35. The nozzle 35 may be configured to provide drilling fluid to a plurality of cutting elements 54 (further explained below) affixed to the blades 40. The drilling fluid may aid in cleaning formation cuttings from the plurality of cutting elements 54 and also provide cooling to the plurality of cutting elements 54. In some embodiments, the at least one nozzle 35 may be located near the blades 40, as shown in FIG. 4. In additional embodiments, the at least one nozzle 35 may be part of or formed in the blades 40 and move with the blades 40.

Referring again to FIG. 3, the expandable reamer tool 10 may include a static inner sleeve member 28 that may be positioned within the longitudinal fluid passageway 17 and fixedly attached to the outer body 16. For example, the static inner sleeve member 28 may be fixedly attached to the fluid bypass member 18 and/or the sleeve retention member 20.

The expandable reamer tool 10 may further include a moveable inner sleeve member 30 that is positioned within the longitudinal fluid passageway 17. At least a portion of the moveable inner sleeve member 30 may be configured to slide within or relative to the static inner sleeve member 28. Initially, the moveable inner sleeve member 30 may be fixedly attached to the outer body 16 in a first, non-actuated position shown in FIG. 3. For example, the moveable inner sleeve member 30 may be fixedly attached to a shear pin retention member 36 using one or more shear pins 38. In other embodiments, shear screws, burst discs, or other mechanisms may be used instead of shear pins 38. The shear pin retention member 36 may be received within the upper portion of sleeve retention member 20 of the outer body 16 and prevented from sliding within the longitudinal fluid passageway 17 toward the first lower end 12 of the expandable reamer tool 10 by the sleeve retention member 20. In this first, non-actuated position shown in FIG. 3, the moveable inner sleeve member 30 is prevented from sliding longitudinally within the longitudinal fluid passageway 17 by the one or more shear pins 38.

The static inner sleeve member 28 and the moveable inner sleeve member 30 each may be substantially open at the opposing longitudinal ends thereof to allow drilling fluid (not shown) to flow through the longitudinal fluid passageway 17 between the upper end 14 and the lower end 12 of the expandable reamer tool 10. The static inner sleeve member 28 also may include one or more slots 29 or openings in the wall thereof configured to define collet latches for securing the moveable inner sleeve member 30 in place after actuation.

The moveable inner sleeve member 30 also may include one or more fluid bypass openings 31 in the walls thereof. In the first, non-actuated position of the expandable reamer tool 10 shown in FIG. 3, these one or more fluid bypass openings 31 may be aligned with the static inner sleeve member 28, which may prevent drilling fluid from flowing out from the moveable inner sleeve member 30 through the one or more fluid bypass openings 31. The moveable inner sleeve member 30 also may include a ball seat surface 32 comprising a necked-down inner diameter of the moveable inner sleeve member 30. The ball seat surface 32 may be used to receive a ball 96 or other restriction element for actuating the expandable reamer tool 10 from the surface of a formation, as described in further detail below.

By way of example and not limitation, the interior surface of the moveable inner sleeve member 30 may be generally cylindrical. A first portion of the interior surface of the moveable inner sleeve member 30 on the side of the ball seat surface 32 toward the upper end 14 of the expandable reamer tool 10 may have an inner diameter that is slightly greater than approximately five centimeters (approximately two inches (2")). A second, relatively smaller portion of the interior surface of the moveable inner sleeve member 30 on the side of the ball seat surface 32 toward the lower end 12 of the expandable reamer tool 10 may have an inner diameter that is slightly less than approximately five centimeters (approximately two inches (2")). By way of example and not limitation, the ball seat surface 32 may comprise a portion of the second, relatively smaller portion of the interior surface of the moveable inner sleeve member 30. In other words, the hydraulic pressure within the moveable inner sleeve member 30 behind the restriction element or ball 96 may force or wedge the restriction element or ball 96 at least partially into the second, relatively smaller portion of the interior surface of the moveable inner sleeve member 30. By forcing or wedging the restriction member or ball 96 at least partially into the second portion of the interior surface of the moveable inner sleeve member 30, which has a diameter slightly less than the diameter of the restriction element or ball 96, the restriction element or ball 96 may be secured or fixed in place after actuation of the moveable inner sleeve member 30. In additional embodiments, the ball seat surface 32 may comprise or be defined by a transition surface having a generally frustoconical shape and extending between the first and second portions of the interior surface of the moveable inner sleeve member 30.

As can be seen with reference to FIGS. 2 and 3, the moveable inner sleeve member 30 may prevent the pressure of any pressurized drilling fluid within the longitudinal fluid passageway 17 from acting on any of the blades 40 when the moveable inner sleeve member 30 and the expandable reamer tool 10 are in the first, non-actuated position shown in FIG. 3. The blades 40 may be biased toward the first radially inward or retracted position shown in FIG. 3. By way of example and not limitation, one or more mechanical spring members 50, shown by way of example only as coil springs, may be used to bias each of the blades 40 toward the first radially inward or retracted position shown in FIG. 3.

Figure 5:
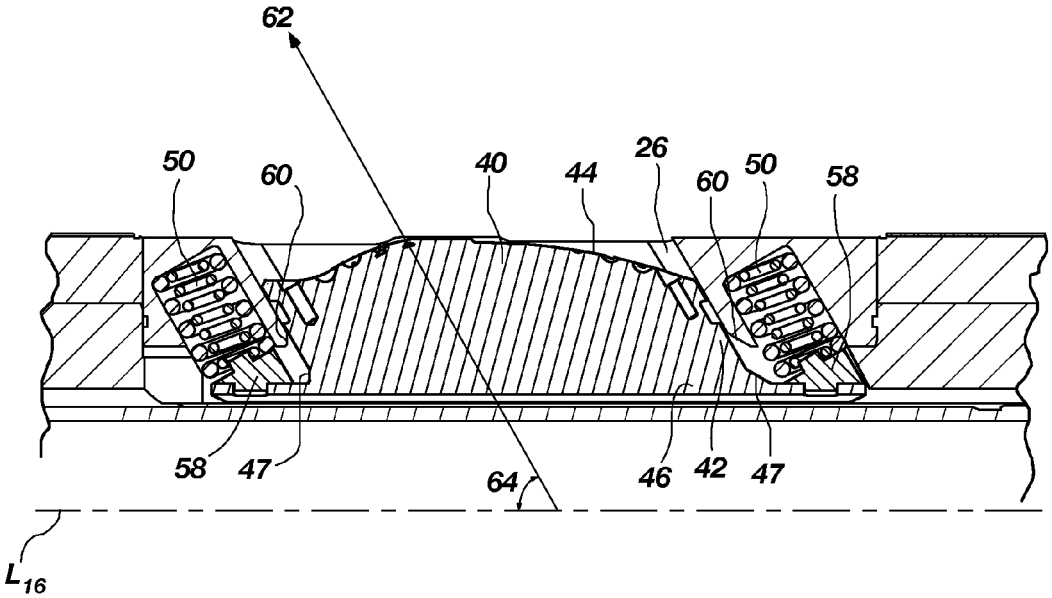
FIG. 5 is an enlarged view of a blade of the expandable reamer tool shown in FIGS. 1 through 4 in a first radially inward or retracted position.
Figure 6:
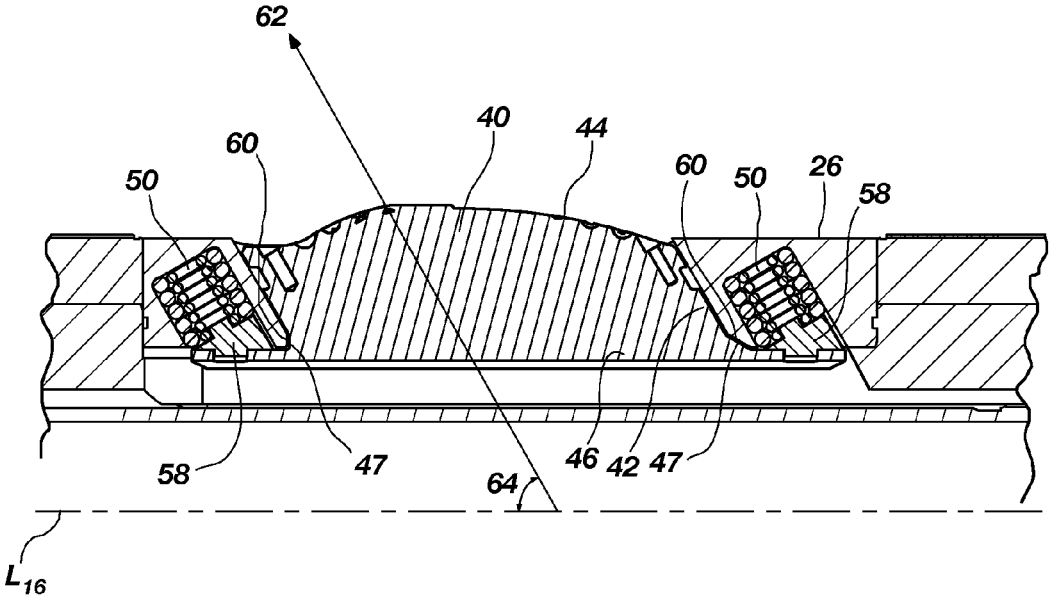
FIG. 6 is an enlarged view of a blade of the expandable reamer tool shown in FIGS. 1 through 4 in a second radially outward or expanded position.

As shown in FIGS. 5 and 6, which are enlarged views of a blade 40 of the expandable reamer tool 10 and the surrounding structure of the expandable reamer tool 10 as shown in FIG. 3, the blades 40 and the outer body 16 of the expandable reamer tool 10 each may be configured such that the blades 40 slide in a generally longitudinally upward and radially outward direction 62 relative to the expandable reamer tool 10 when the blades 40 are moved from the first radially inward or retracted position (shown in FIG. 5) to the second radially outward or expanded position (shown in FIG. 6). By way of example and not limitation, the direction 62 may extend at an acute angle 64 of less than ninety degrees (90°) with respect to the longitudinal axis $L_{16}$ of the outer body 16. More particularly, the direction 62 may extend at an acute angle between approximately fifteen degrees (15°) and seventy-five degrees (75°) with respect to the longitudinal axis $L_{16}$. As non-limiting examples, the direction 62 may extend at an acute angle of about sixty degrees (60°) with respect to the longitudinal axis $L_{16}$, or the direction 62 may extend at an acute angle of about thirty degrees (30°) with respect to the longitudinal axis $L_{16}$. The blades 40 may be configured to slide between the first radially inward or retracted position and the second radially outward or expanded position within a slot 51 (FIG. 1) formed within the blade plate 26 of the outer body 16.

Figure 8:
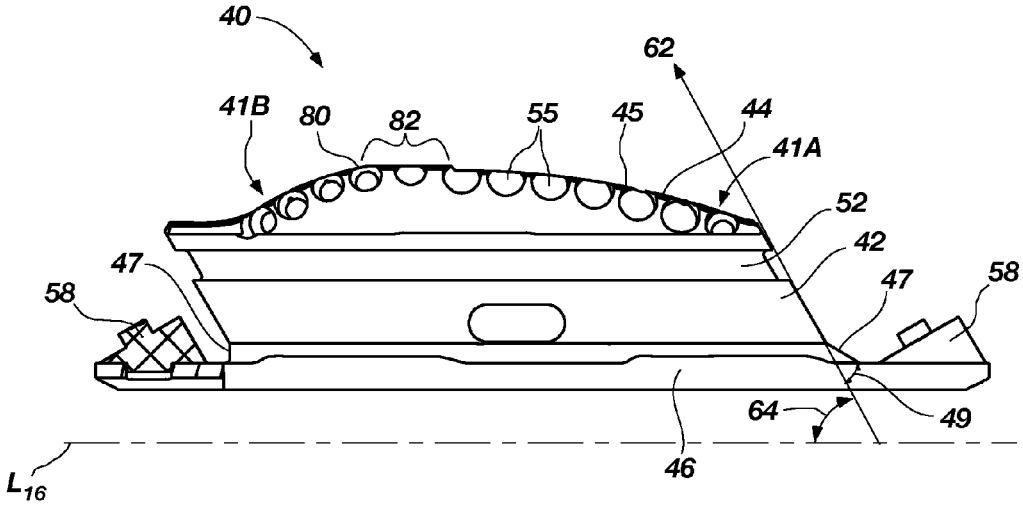
FIG. 8 is a side view of the blade shown in FIG. 7.

As shown in FIG. 5, a blade body 42 may include a base portion 46. The base portion 46 may include at least one angled surface 47 (also shown in FIG. 8). The at least one angled surface 47 may be configured to wedge against at least one complementary angled surface 60 of the outer body 16, and more particularly the blade plate 26, when the blades 40 are in the second radially outward or expanded position, as shown in FIG. 6. When in the second radially outward or expanded position, the at least one angled surface 47 of the base portion 46 of the blade body 42 and the at least one complementary angled surface 60 of the blade plate 26 may faun a metal-to-metal seal. In additional embodiments, the angled surface 60 may extend at an angle other than the angle at which the at least one angled surface 47 extends to provide a seal along a line instead of a surface area. The engagement between the blade body 42 and the outer body 16 prevents vibrations of the blades 40 and centralizes the blades 40 in the blade plate 26 of the outer body 16. In some embodiments, as shown in FIG. 8, the at least one angled surface 47 may be oriented at an acute angle 49 between about fifteen degrees (15°) and about seventy-five degrees (75°) relative to the direction 62 in which the blades 40 are configured slide relative to the outer body 16. As one non-limiting example, the at least one angled surface 47 may be oriented at an acute angle of about thirty degrees (30°) with respect to the direction 62 in which the blades 40 are configured to slide.

Figure 7:
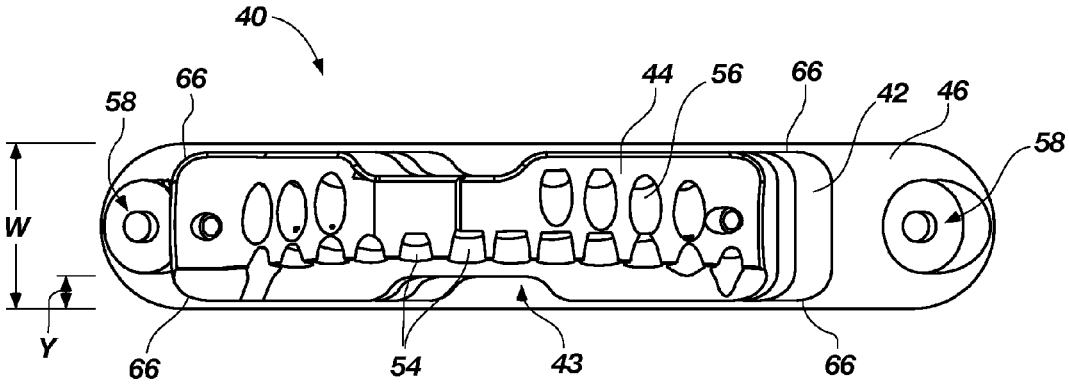
FIG. 7 is a top view of a blade of the expandable reamer tool shown in FIGS. 1 through 4.

As shown in FIG. 7, which is a top view of a blade 40 of the expandable reamer tool 10 shown in FIGS. 1 through 4, the blade body 42 may include a radially outward formation-engaging surface 44 that is configured to engage a subterranean formation within a borehole when the blade 40 is in the second radially outward or expanded position (shown in FIG. 6). A plurality of cutting elements 54 may be provided on the formation-engaging surface 44 proximate a rotationally leading side surface 45 of the blade 40. By way of example and not limitation, the cutting elements 54 may include polycrystalline diamond compact (PDC) cutting elements. A plurality of wear-resistant structures 56 may also be provided on or in the formation-engaging surface 44 of the blade 40 generally rotationally behind the cutting elements 54. The wear-resistant structures 56 may include, for example, wear knots, studs, wear-resistant inserts, additional cutting elements, or any other structures that are relatively more wear-resistant than the blade body 42. Furthermore, abrasive wear-resistant hardfacing material may be applied to any exterior surface of the blade 40 that may engage a subterranean formation when the blade 40 is disposed in the radially outward or expanded position.

The blades 40 also may include one or more spring-supporting members 58 configured to abut against and retain an end of the springs 50 (FIG. 3) for biasing the blades 40 toward the retracted position. In some embodiments, the spring-supporting members 58 may be discrete members that are attached to the blade body 42. In additional embodiments, the spring-supporting members 58 may comprise an integral portion of the blade body 42 that is machined or otherwise shaped as necessary to form the spring-supporting members 58.

As shown in FIG. 7, each blade 40 may have one or more keyways 43 formed in one or both of the lateral surfaces of the blade body 42. As shown in FIG. 7, the keyways 43 may have a generally rectangular cross-sectional shape. In other embodiments, however, the keyways 43 may have a generally circular or square cross-sectional shape. By way of example and not limitation, the keyways 43 may extend a depth Y into the blade 40 that is greater than about ten percent (10%) of a largest width W of the blade 40. In some embodiments, the keyways 43 may extend a depth Y into the blade 40 that is between about ten percent (10%) and about thirty percent (30%) of the largest width W of the blade 40. Complementary inwardly extending tracks or protrusions 48 (shown in FIG. 1) may be provided on the sidewalls of the blade plate 26 (FIG. 3) of the outer body 16 of the expandable reamer tool 10 within the slot 51 (FIG. 1) in which the blades 40 are configured to slide. As the blades 40 slide in the slot 51 provided in the walls of the blade plate 26 of the outer body 16, the tracks or protrusions 48 may slideably engage the corresponding keyways 43 provided in the lateral surfaces of the blades 40. The complementary protrusions 48 and keyways 43 may ensure that the blades 40 slide in the generally longitudinally upward and radially outward direction 62 (see FIGS. 5 and 6) relative to the expandable reamer tool 10 when the blades 40 are moved from the first radially inward or retracted position to the second radially outward or expanded position.

Furthermore, as shown in FIG. 7, the keyways 43 may have a cross-sectional shape comprising a plurality of curved edges extending generally parallel to the direction 62 in which the blade 40 is configured to slide. By way of example and not limitation, each curved edge of the plurality of curved edges may have a radius that is between about five percent (5%) of the largest width W of the blade 40 and about forty percent (40%) of the largest width W of the blade 40. In some embodiments, each curved edge of the plurality of curved edges may have a radius that is between about five percent (5%) of the largest width W of the blade 40 and about twenty percent (20%) of the largest width W of the blade 40. The tracks or protrusions 48 may comprise a plurality of complementary curved edges to the plurality of curved edges of the keyways 43. The complementary curved edges of the keyways 43 and the tracks or protrusions 48 may facilitate the slideable engagement between the keyways 43 and the tracks or protrusions 48. Furthermore, the complementary curved edges of the keyways 43 and the tracks or protrusions 48 may reduce the possibility of the blade 40 binding in the slot 51 when moving between the first radially inward or retracted position and the second radially outward or expanded position.

As shown in FIG. 7, the blade 40 may have a generally rectangular cross-sectional or box-like shape. The relatively sharp corners 66 of the blade 40 may have a radius that is between about zero centimeters (inches (0")) and about 2.54 centimeters (one inch (1")). The box-like shape of the blade 40 may prevent binding of the blade 40 in the slot 51 of the blade plate 26 of the outer body 16 as the blade 40 slides between the first radially inward or retracted position and the second radially outward or expanded position. The relatively sharp corners 66 of the blade 40 also prevent the blade 40 from rocking back and forth and from rotating relative to the outer body 16 during reaming/drilling operations.

FIG. 8 is a side view of the blade 40 shown in FIG. 7. The cutting elements 54 are not shown in FIG. 8 to illustrate cutting element pockets 55 that may be formed in the blade 40 for receiving the cutting elements 54 (FIG. 7) therein. The cutting elements 54 may be secured within the cutting element pockets 55 using, for example, a brazing material or an adhesive.

As also shown in FIG. 8, the formation-engaging surface 44 of the blade 40 may have a generally arcuate shape at both the longitudinally forward region 41A and the longitudinally rearward region 41B of the blade 40. Furthermore, the cutting elements 54 (FIG. 7) may be provided at both the longitudinally forward region 41A and the longitudinally rearward region 41B of the blade 40. In this configuration, the expandable reamer tool 10 may be used for both forward reaming and back reaming, as described above.

Figure 9:
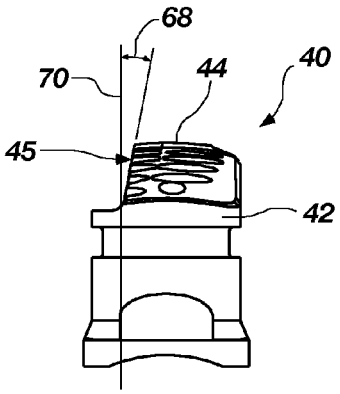
FIG. 9 is an end view of the blade shown in FIG. 7.

FIG. 9 is an end view of a portion of the blade 40 shown in FIGS. 7 and 8. As shown in FIG. 9, in some embodiments, the rotationally leading side surface 45 of the blade 40 may be disposed at an acute back angle 68 of between about zero degrees (0°) and about forty-five degrees (45°) with respect to a plane 70 longitudinally bisecting the outer body 16 of the expandable reamer tool 10 and containing the longitudinal axis $L_{16}$.

Referring again to FIG. 3, the expandable reamer tool 10 may be relatively freely moveable within a well bore when the expandable reamer tool 10 is in the non-actuated position and the blades 40 are in the corresponding first radially inward or retracted position. In this configuration, the expandable reamer tool 10 may be positioned at a selected location within a well bore at which it is desired to ream-out the well bore (i.e., enlarge the size or diameter of the well bore). After positioning the expandable reamer tool 10 at the selected location, the expandable reamer tool 10 may be actuated to cause the blades 40 to move in a generally radially outward and longitudinally upward direction. To actuate the expandable reamer tool 10, a restriction element, in some embodiments a generally spherical ball 96, may be dropped down into the drill string to which the expandable reamer tool 10 is secured. The generally spherical ball 96 may be provided with a diameter that is small enough to enable the ball to pass through the longitudinal fluid passageway 17 to the ball seat surface 32, but too large to allow the ball 96 to pass beyond the ball seat surface 32. In this configuration, the flow of drilling fluid through the longitudinal fluid passageway 17 may cause the ball 96 to seat against the ball seat surface 32, which may temporarily prevent drilling fluid from flowing through the moveable inner sleeve member 30.

As the flow of drilling fluid is temporarily interrupted by the seating of the ball 96 against the ball seat surface 32, the pressure differential between the portion of the longitudinal fluid passageway 17 above and below the ball 96 caused by the drilling fluid pressure trapped by the ball 96 within the moveable inner sleeve member 30 may exert a force on the moveable inner sleeve member 30 in the longitudinally forward direction (i.e., toward the lower end 12 of the expandable reamer tool 10). The shear pins 38 may be configured to selectively fail when the pressure of the drilling fluid within the moveable inner sleeve member 30 reaches a threshold magnitude or level (and, hence, the force acting on the moveable inner sleeve member 30 in the longitudinally forward direction reaches a threshold magnitude or level). In other words, the shear pins 38 may be configured to selectively fail when the pressure differential above and below the ball 96 in the longitudinal fluid passageway 17 of the expandable reamer tool 10 reaches a threshold level. After the shear pins 38 have failed, the pressure within the moveable inner sleeve member 30 above the ball 96 may cause the inner sleeve member 30 to slide within the static inner sleeve member 28 in the longitudinally forward direction until an outer lip or projection 74 on the exterior surface of the moveable inner sleeve member 30 abuts against an end 76 or other feature of the static inner sleeve member 28. Abutment of the outer lip or projection 74 on the exterior surface of the moveable inner sleeve member 30 against the end 76 or other feature of the static inner sleeve member 28 may prevent further longitudinal movement of the moveable inner sleeve member 30 within the expandable reamer tool 10. Furthermore, abutment of the outer lip or projection 74 on the exterior surface of the moveable inner sleeve member 30 against the end 76 or other feature of the static inner sleeve member 28 may be cushioned with a shock absorbing member comprising a rubber material or any other resilient material.

A collet or other locking-type mechanism may be provided on the static inner sleeve member 28 that is configured to lock the moveable inner sleeve member 30 in the longitudinally forward or actuated position to prevent subsequent movement of the moveable inner sleeve member 30 within the expandable reamer tool 10. Similarly, a swage tube or other device or mechanism may be provided on the longitudinally forward region of the moveable inner sleeve member 30 for securing the ball 96 against the ball seat surface 32 to prevent subsequent movement of the ball 96 within the expandable reamer tool 10.

After the expandable reamer tool 10 has been actuated to cause the shear pins 38 to fail and the moveable inner sleeve member 30 to slide to the longitudinally forward position, the fluid bypass openings 31 may be positioned within a region of the fluid bypass member 18 having an enlarged inner diameter. As a result, drilling fluid is enabled to flow out from the moveable inner sleeve member 30 through the fluid bypass openings 31 into the annular-shaped space between the exterior surface of the moveable inner sleeve member 30 and the interior surface 19 of the fluid bypass member 18, around the longitudinally forward region of the moveable inner sleeve member 30 (the end plugged by the ball 96), and out through the lower end 12 of the expandable reamer tool 10.

Furthermore, after the expandable reamer tool 10 has been actuated to cause the shear pins 38 to fail and the moveable inner sleeve member 30 to slide to the longitudinally forward position, the pressure of the drilling fluid within the longitudinal fluid passageway 17 may act directly upon the blades 40, which may cause the blades 40 to move from the first radially inward or retracted position to the second radially outward or expanded position and engage the subterranean formation within the well bore. The drilling fluid within the longitudinal fluid passageway 17 may be in direct physical contact with at least a portion of each of the blades 40. In this configuration, the only significant force acting on the blades 40 to cause the blades 40 to move to the radially outward or expanded position is the force generated by the hydraulic pressure within the longitudinal fluid passageway 17.

Once the blades 40 are moved to the second radially outward or expanded position (shown in FIG. 6), the expandable reamer tool 10 then may be rotated to cause the cutting elements 54 (described below) to scrape against and shear away the formation material of the wall of the borehole and enlarge or ream out the borehole. For forward reaming applications, the rotating expandable reamer tool 10 may be advanced or pushed in the forward direction toward the lower end 12 thereof as the expandable reamer tool 10 is rotated. For backward reaming applications ("backreaming"), the rotating expandable reamer tool 10 may be retracted or pulled in the backward or rearward direction toward the upper end 14 thereof as the expandable reamer tool 10 is rotated. After reaming the borehole as necessary or desired, the hydraulic pressure within the longitudinal fluid passageway 17 may be reduced below the threshold level to allow the spring members 50 to cause the blades 40 to return to the first radially inward or retracted position. The expandable reamer tool 10 then may be tripped out from the borehole to the surface.

In some cases, formation cuttings or other debris may cause one or more of the blades 40 to tend to jam or stick in the radially outward or expanded position. By configuring the blades 40 and the outer body 16 of the expandable reamer tool 10, as previously described with reference to FIGS. 5 and 6, such that the blades 40 slide in a generally longitudinally upward and radially outward direction 62 relative to the expandable reamer tool 10, any force acting on such jammed or stuck blades 40 by the subterranean formation (or a casing shoe, for example) in response to retracting or pulling the expandable reamer tool 10 out from the borehole may force or push the potentially jammed or stuck blades 40 into the first radially inward or retracted position without causing the blades 40 to bind against the outer body 16 (e.g., against the blade plate 26). In other words, pulling the expandable reamer tool 10 out from the borehole may force otherwise potentially stuck or jammed blades 40 back into the first radially inward or retracted position. As a result, removal of the expandable reamer tool 10 out from the borehole may be facilitated.

Referring again to FIG. 7, the cutting elements 54 located on the longitudinally rearward side of the blades 40 (the side of the blades 40 proximate the upper end 14 of the expandable reamer tool 10 (FIG. 3)) may be relatively more recessed within the blades 40 relative to other cutting elements 54 on the blades 40. By way of example and not limitation, the cutting elements 54 located on the longitudinally rearward side of the blades 40 may extend 0.3175 centimeter (one-eighth an inch (⅛")) or less beyond the formation-engaging surface 44. In some embodiments, the cutting elements 54 located on the longitudinally rearward side of the blades 40 may not extend beyond the formation-engaging surface 44 but instead may be substantially flush or slightly recessed below the formation-engaging surface 44. This recessing of the cutting elements 54 located on the longitudinally rearward side of the blade 40 prevents these cutting elements 54 from catching on casing or other structures within the borehole as the expandable reamer tool 10 is pulled out from the borehole. As a result, removal of the expandable reamer tool 10 out from the borehole may be further facilitated.

Figure 10:
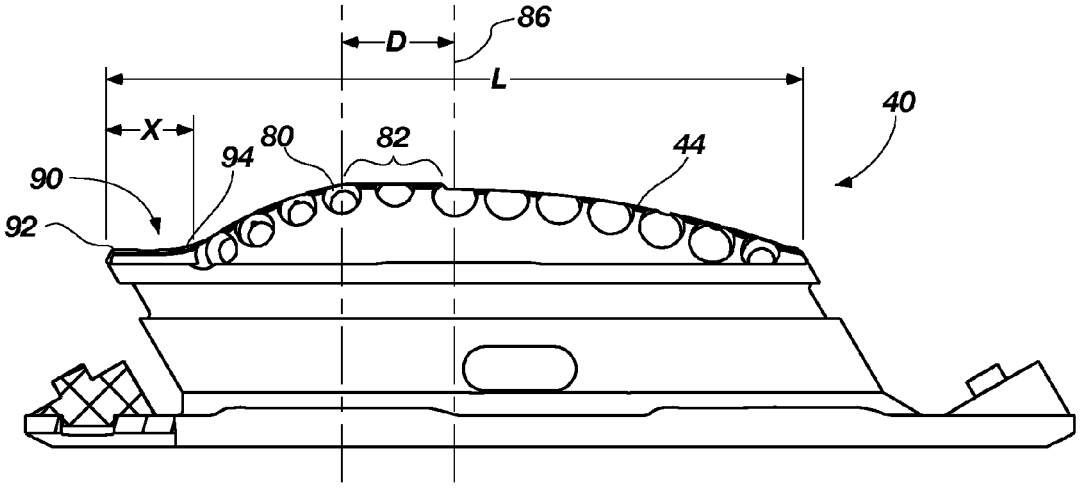
FIG. 10 is substantially identical to FIG. 8 and illustrates additional aspects of some embodiments of the present invention.

FIG. 10 is substantially identical to FIG. 8 and illustrates additional aspects of some embodiments of the present invention. As shown in FIG. 10, in some embodiments of the present invention, the longitudinally rearward-most point 80 of the gage area or region 82 (i.e., the radially outward-most area or region on each blade 40) may be located at a distance D from a longitudinal centerline 86 of the formation-engaging surface of the blade 40 that is less than about twenty-five percent (25%) of the longitudinal length L of the formation-engaging surface 44 of the blade 40. More particularly, the longitudinally rearward-most point 80 of the gage area or region 82 may be located at a distance D from a longitudinal centerline 86 of the blade 40 that is less than about twenty percent (20%) of the longitudinal length L of the formation-engaging surface 44 of the blade 40.

In some situations, the longitudinally rearward-most point 80 of the gage area or region 82 may provide the first point of contact between the blade 40 and a casing or other feature within a borehole should the blade 40 tend to jam or stick in the second radially outward or expanded position when it is attempted to pull the expandable reamer tool 10 out of the borehole. By positioning the longitudinally rearward-most point 80 of the gage area or region 82 proximate the longitudinal centerline 86 of the formation-engaging surface 44 of the blade 40, the blade 40 may be less likely to bind against the outer body 16 (e.g., against the blade plate 26) of the expandable reamer tool 10 when a potentially stuck or jammed blade 40 engages a casing or other feature within a borehole as the expandable reamer tool 10 is pulled out from the borehole. In other words, any force acting on the longitudinally rearward-most point 80 of the gage area or region 82 caused by the contacting of a casing or other feature within a borehole may cause the blade 40 to slide from the second radially outward or expanded position to the first radially inward or retracted position. As a result, removal of the expandable reamer tool 10 out from the borehole may be yet further facilitated.

As also shown in FIG. 10, in some embodiments of the present invention, one or more of the blades 40 may include a recessed area 90 of the formation-engaging surface 44. The recessed area 90 of the formation-engaging surface 44 may be disposed adjacent or proximate the rearward-most, or back end, of the blade 40 (i.e., the end of the blade proximate the second upper end 14 of the expandable reamer tool 10). In some embodiments, the recessed area 90 may be substantially free of cutting elements 54 (FIG. 7). In additional embodiments, the recessed area 90 may be generally planar. As shown in FIG. 6, in some embodiments, the recessed area 90 may be slightly recessed within the blade plate 26 when the at least one blade 40 is in the expanded position. In additional embodiments, the recessed area 90 may be substantially flush with the outer surface 27 of the blade plate 26 when the at least one blade 40 is in the expanded position. By way of example and not limitation, the recessed area 90 may extend in the longitudinally forward direction (i.e., toward the first lower end 12 of the expandable reamer tool 10) a distance X from a back edge 92 of the formation-engaging surface 44 to a location 94 at which the formation-engaging surface 44 begins to curve radially outwardly. In some embodiments, the recessed area 90 may extend from the back edge 92 of the formation-engaging surface 44 to a location proximate the rearward-most cutting element 54 on or in the formation-engaging surface 44. As a non-limiting example, the distance X may be between about five percent (5%) of the longitudinal length L of the fox nation-engaging surface 44 of the blade 40 and about forty percent (40%) of the longitudinal length L of the formation-engaging surface 44 of the blade 40. More particularly, the distance X may be between about seven percent (7%) of the longitudinal length L of the formation-engaging surface 44 of the blade 40 and about fifteen percent (15%) of the longitudinal length L of the formation-engaging surface 44 of the blade 40.

In some situations, the location 94 at which the formation-engaging surface 44 begins to curve radially outwardly may define the first point of contact between the blade 40 and a casing or other feature within a borehole should the blade 40 tend to jam or stick in the second radially outward or expanded position and it is attempted to pull the expandable reamer tool 10 out from the borehole. By positioning the location 94 at which the formation-engaging surface 44 begins to curve radially outwardly closer to the longitudinal centerline 86 of the formation-engaging surface of the blade 40, the blade 40 may be less likely to bind against the outer body 16 of the expandable reamer tool 10 when a potentially stuck or jammed blade 40 engages a casing or other feature within a borehole as the expandable reamer tool 10 is pulled out from the borehole. In other words, a pushing force of the casing or other feature within a borehole against the blade 40 may force the blade 40 to retract or move in the direction 62 at the acute angle 64 relative to the longitudinal axis $L_{16}$ shown in FIGS. 5 and 6 from the second radially outward or expanded position to the first radially inward or retracted position. As a result, removal of the expandable reamer tool 10 out from the borehole may be further facilitated.

Figure 11:
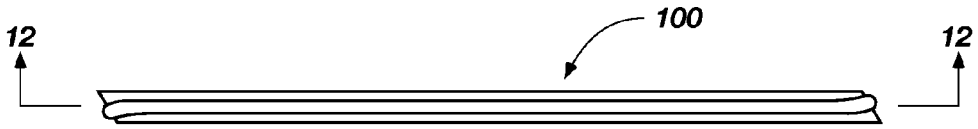
FIG. 11 is a side view of a seal structured in accordance with an embodiment of the present invention.
Figure 12:
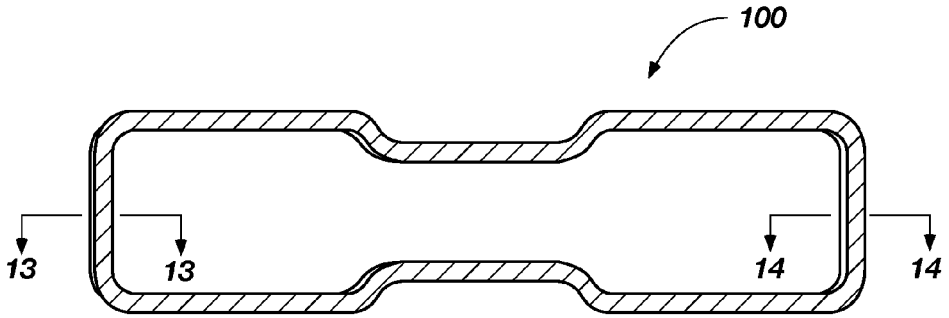
FIG. 12 is a top-sectional view of the seal shown in FIG. 11 taken along section line 12-12 shown in FIG. 11.
Figure 13:
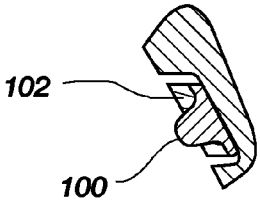
FIG. 13 is a cross-sectional view of the seal shown in FIGS. 11 and 12 taken along section line 13-13 shown in FIG. 12.
Figure 14:
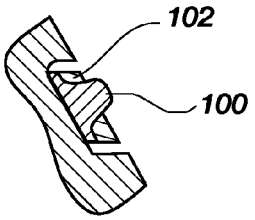
FIG. 14 is a cross-sectional view of the seal shown in FIGS. 11 and 12 taken along section line 14-14 shown in FIG. 12.

Also, generally applicable to some of the embodiments of the present invention is a particular seal arrangement shown in FIGS. 11 through 15. As shown in FIG. 11, some embodiments of the present invention may include a T-shaped seal 100 comprising a relatively soft material, such as a polymer or polymer blend material. In some embodiments the T-shaped seal 100 may be formed from hydrogenated nitrile butadiene rubber (HNBR), VITON®, or nitrile rubber. As shown in FIG. 12, a top-sectional view of the T-shaped seal 100 of FIG. 11, the T-shaped seal 100 may be configured to correspond in shape to the shape of the blades 40. In particular, the T-shaped seal 100 may be configured to be seated in a recess 52 (FIG. 8) extending around each of the blades 40. As shown in FIG. 11 and more particularly in FIGS. 13 and 14, which are cross-sectional views of the T-shaped seal 100 taken along the lines 13-13 and 14-14 of FIG. 12, the T-shaped seal 100 may be configured to abut against the blade plate 26 of the outer body 16 and particularly against the surfaces of the slot 51 (FIG. 1) of the blade plate 26 at an angle perpendicular to each surface of the slot 51 in communication with the T-shaped seal 100.

Figure 15:
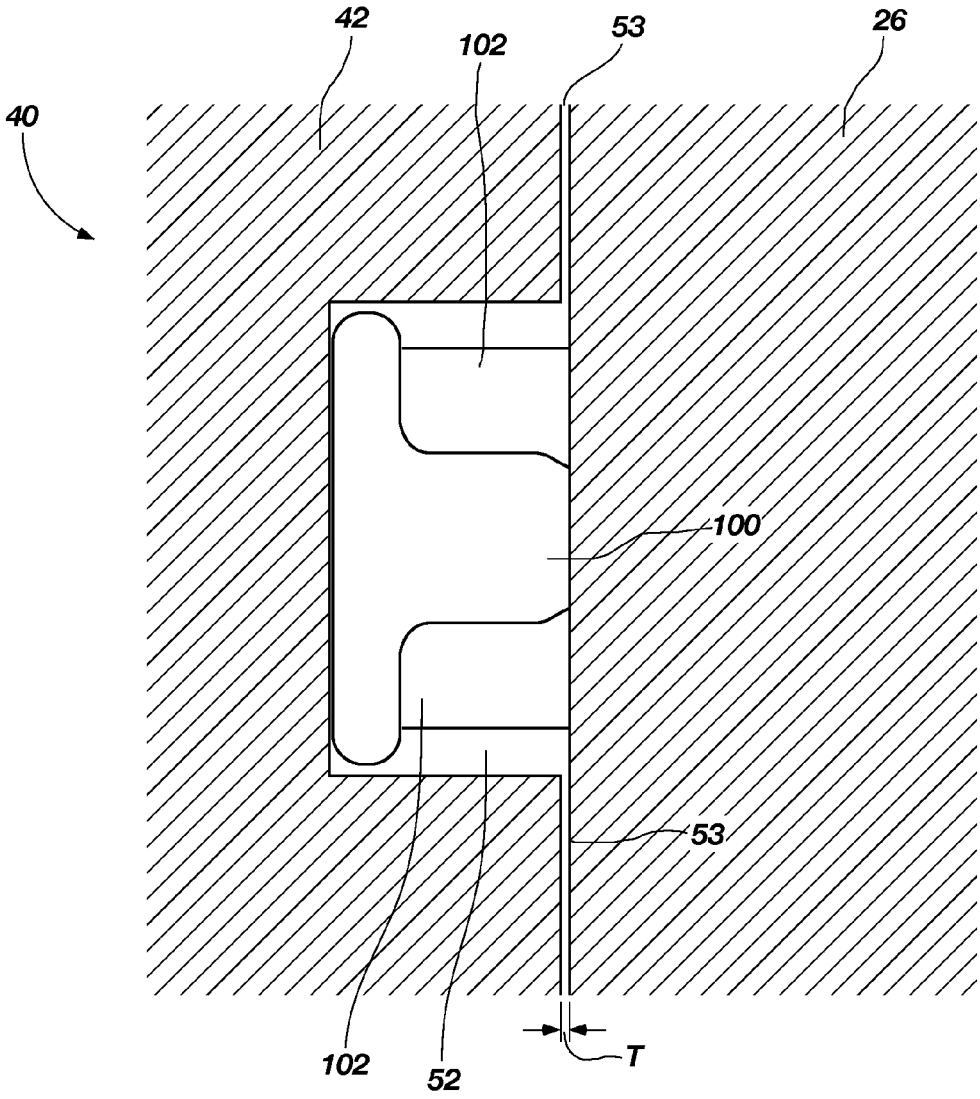
FIG. 15 is an enlarged cross-sectional view of a portion of the seal shown in FIGS. 11 through 14 disposed at an interface between a blade and a surrounding body of the expandable reamer tool shown in FIG. 2.

FIG. 15 is an enlarged view of the portion within box 15 shown in FIG. 2 and illustrates the T-shaped seal 100 in engagement between the blade body 42 and the blade plate 26 off the outer body 16. As shown in FIG. 15, the T-shaped seal 100 may engage the surfaces 53 of the slot 51 of the blade plate 26 of the outer body 16 perpendicularly or at a 90-degree angle (90°). Additionally, when in engagement with the surfaces 53 of the slot 51, the T-shaped seal 100 may be subjected to a ten percent (10%) or more squeeze or compression. In other words, the thickness of the T-shaped seal 100 in its relaxed or non-compressed state may be decreased by about ten percent (10%) or more when the T-shaped seal 100 is positioned between the blade 40 and the blade plate 26 of the outer body 16, as shown in FIG. 15. In some embodiments, the T-shaped seal 100 may be subjected to a twenty percent (20%) or more squeeze or compression.

Referring again to FIG. 15, the T-shaped seal 100 may include one or more backup rings 102. The backup rings 102 may be formed from a material that may be stiffer than the material of the T-shaped seal 100 such as, for example, polyetheretherketone (PEEK™), polytetrafluoroethylene (TEFLON®), polytetrafluoroethylene impregnated with bronze, or other suitable materials.

The T-shaped seal 100 may be relatively elastic and may be stretched as they are passed over and around a blade 40 and positioned within a groove 52 on the blade 40. Because the backup rings 102 may be relatively stiff, they may each have a cut therethrough to allow the backup rings 102 to be expanded to an enlarged diameter to allow them to pass over and around the body of the blades 40 as they are seated within a groove 52 over a T-shaped seal 100. The backup rings 102 may help maintain the T-shaped seals 100 within the grooves 52 (FIG. 8) of the blades 40. Furthermore, the backup rings 102 may inhibit interaction between the T-shaped seal 100 and contaminants. More specifically, as shown in FIG. 15, upon compression of the T-shaped seal 100 by way of adjacent surface 53 of the blade plate 26 within the slot 51, the backup rings 102 may also contact the adjacent surfaces 53 of the blade plate 26. Thus, as the T-shaped seal 100 and surfaces 53 of the blade plate 26 move relative to one another, the backup rings 102 contact the surfaces 53 of the blade plate 26 prior to the T-shaped seal 100, in each direction of travel. The backup rings 102 may, therefore, facilitate removal of debris and other contaminants from the surfaces 53 and thereby inhibit contaminants from contacting T-shaped seal 100. In some embodiments, the backup rings 102 may include ridges or other non-planar surface geometry to further facilitate removal of contaminants.

Referring again to FIG. 15, a clearance T may be provided between each blade 40 and the surrounding surfaces of the blade plate 26 of the outer body 16 of the expandable reamer tool 10 that is large enough to allow the blade 40 to freely slide within the blade plate 26, yet small enough to minimize or prevent formation cuttings or other debris from lodging between the blades 40 and the outer body 16 and to guide the blades 40 as they move within or relative to the blade plate 26 of the outer body 16. By way of example and not limitation, a clearance T of greater than about 0.0254 centimeter (about ten-thousandths of an inch (0.010")) may be provided between each surface of the blades 40 and the surrounding surfaces of the blade plate 26 of the outer body 16. Providing a clearance T of at least 0.0254 centimeter (about ten-thousandths of an inch (0.010")) or more may help to prevent the blades 40 from binding in the slot 51 of the blade plate 26 of the outer body 16. In some embodiments, the clearance T between the lateral side surfaces of the blades 40 and the surrounding surfaces of the outer body 16 (e.g., the blade plate 26) may be about 0.0381 centimeter (about fifteen-thousandths of an inch (0.015")), and a clearance T of between about 0.0635 centimeter (about twenty-five-thousandths an inch (0.025")) and about 0.1143 centimeter (about forty-five-thousandths of an inch (0.045")) may be provided between the end surfaces of the blades 40 and the surrounding surfaces of the outer body 16.

While the present invention has been described herein with respect to certain preferred embodiments, those of ordinary skill in the art will recognize and appreciate that it is not so limited. Rather, many additions, deletions and modifications to the preferred embodiments may be made without departing from the scope of the invention as hereinafter claimed. In addition, features from one embodiment may be combined with features of another embodiment while still being encompassed within the scope of the invention as contemplated by the inventors. Further, the invention has utility with different and various blade profiles as well as cutter types and configurations.

What is claimed is:

1. An expandable reamer tool, comprising:

an outer body having a fluid passageway extending therethrough; and at least one blade configured to move, relative to the outer body and in a slot defined by a blade plate of the outer body, between a retracted position and an expanded position, the slot having a longitudinally forward surface and a longitudinally rearward surface angled at an acute angle relative to a longitudinal axis of the outer body, the at least one blade having a formation-engaging surface comprising:

a longitudinally forward region sup porting at east one forward cutting element;

a longitudinally rearward region supporting at least one rear cutting element, the at least one forward cutting element configured to, at initial formation of the expandable reamer tool and prior to engagement with an earthen formation, extend beyond the formation-engaging surface of the at least one blade a distance greater than any distance the at least one rear cutting element extends beyond the formation-engaging surface such that the at least one forward cutting element exhibits an exposure that is greater than any exposure exhibited by the at least one rear cutting element; and a recessed area disposed between a back edge of the formation-engaging surface and the at least one rear cutting element of the longitudinally rearward region, the recessed area having a concave curve extending from proximate the back edge toward the at least one rear cutting element.

2. The expandable reamer tool of claim 1, wherein the at least one rear cutting element extends a distance of about an eighth of an inch (⅛") or less beyond the formation-engaging surface of the at least one blade.

3. The expandable reamer tool of claim 1, wherein the at least one rear cutting element is substantially flush with the formation-engaging surface of the at least one blade.

4. The expandable reamer tool of claim 1:

wherein the at least one blade is configured to move, relative to the outer body, between the retracted position and the expanded position in a direction oriented at an acute angle of less than ninety degrees)(90°) to the longitudinal axis of the outer body while a surface of the at least one blade, directed toward the fluid passageway, remains parallel to the longitudinal axis; and further comprising a seal between the outer body and each lateral surface of the at least one blade adjacent the outer body, wherein the seal abuts against the outer body at an angle substantially perpendicular to each surface of the outer body in contact with the seal.

5. The expandable reamer tool of claim 4, wherein ti e sea has a generally T-shaped cross-sectional area.

6. The expandable reamer tool of claim 4, wherein a longitudinally forward most portion of the seal extends in a generally radially outward direction away from the longitudinal axis of the outer body and a longitudinally rearward most portion of the seal extends in a generally radially inward direction toward the longitudinal axis of the outer body.

7. The expandable reamer tool of claim 4, further comprising at least one backup ring adjacent the seal.

8. The expandable reamer tool of claim 7, wherein the at least one backup ring comprises polyetheretherketone.

9. The expandable reamer tool ofclaim 4, wherein the seal is seated in a recess extending around the at least one blade.

10. The expandable reamer tool of claim 4, wherein the seal comprises hydrogenated nitrile butadiene rubber (HNBR) or nitrile rubber.

11. The expandable reamer tool of claim 1, wherein the at least one rear cutting element is recessed below the formation-engaging surface of the at least one blade.

12. The expandable reamer tool of claim 1, wherein the formation-engaging surface further comprises a gage area between the longitudinally forward region and the longitudinally rearward region, a longitudinally rearward-most point of the gage area located a distance from a longitudinal centerline of the fbrmation-engaging surface that is less than about twenty-five percent (25%) of a longitudinal length of the formation-engaging surface.

13. The expandable reamer tool of claim 1, wherein:

the longitudinally forward region further comprises at least one wear-resistant structure rotationally behind the at least one forward cutting element; and the longitudinally rearward region further comprises at least another wear-resistant structure rotationally behind the at least one rear cutting element.

14. The expandable reamer tool of claim 1, wherein the at least one blade comprises at least one corner having a radius between about zero centimeters (inches (0")) and about 2.54 centimeters (one inch (1")).

15. An expandable reamer tool, comprising:

an outer body having a fluid passageway extending therethrough, and at least one blade configured to move relative to the outer body between a retracted position and an expanded position, the at least one blade having a formation-engaging surface comprising:

a longitudinally forward region supporting at least one forward cutting element; and a longitudinally rearward region supporting at least one rear cutting element, the at least one forward cutting element exhibiting an exposure that is greater than any exposure exhibited by the at least one rear cutting element;

wherein the at least one blade comprises at least one lateral surface defining at least one keyway configured to slideably engage a corresponding protrusion of the expandable reamer tool.

16. The expandable reamer tool of claim 15, wherein the at least one keyway comprises a plurality of curved edges, at least one curved edge of the plurality of curved edges comprising a radius between about five percent (5%) and about twenty percent (20%) of a largest width of the at least one blade.

17. An expandable reamer tool, comprising:

an outer body having a fluid passageway extending therethrough;

at least one blade configured to move relative to the outer body between a retracted position and an expanded position, the at least one blade having a formation-engaging surface comprising:

a gage area, a longitudinally rearward-most point of the gage area being located a distance from a longitudinal centerline of the formation-engaging surface that is less than about twenty-five percent (25%) of a longitudinal length of the formation-engaging surface; and a substantially planar recessed area substantially free of cutting elements, the substantially planar recessed area extending in a longitudinally forward direction from a rearward-most end of the formation-engaging surface of the at least one blade to a region including cutting elements and at which the formation-engaging surface begins to concavely curve radially outward to the gage area.

18. The expandable reamer tool of claim 17, further comprising at least one biasing member engaged with the at least one blade, the at least one biasing member comprising at least one mechanical spring member.

19. The expandable reamer tool of claim 18, wherein the at least one biasing member further comprises at least one spring-supporting member configured to abut against and retain an end of the at least one mechanical spring member.

20. The expandable reamer tool of claim 17, wherein the at least one blade comprises a rotationally leading side surface disposed at an angle of between zero degrees)(0°) and forty-five degrees (45°) with respect to a plane longitudinally bisecting the outer body.

21. The expandable reamer tool of claim 17, further comprising at least one biasing member longitudinally adjacent to the formation-engaging surface and configured to bias the at least one blade at an acute angle relative to a surface of the at least one blade while the surface is parallel to a longitudinal axis of the outer body, the surface exposed to the fluid passageway.

22. The expandable reamer tool of claim 17, wherein the at least one blade is configured to move, relative to the outer body, between a retracted position and an expanded position in a direction oriented at an acute angle of less than ninety degrees (90°) to a longitudinal axis of the outer body and while maintaining a surface of the at least one blade in a parallel disposition relative to a longitudinal axis of the outer body, the surface facing the fluid passageway.

* * * * *